United States Patent [19]

Katz et al.

[11] 4,132,639

[45] Jan. 2, 1979

[54] METHOD FOR IMPROVING THE SEDIMENTATION AND FILTERABILITY OF COAL-DERIVED LIQUIDS

[75] Inventors: Sidney Katz, Oak Ridge; Billy R. Rodgers, Concord, both of Tenn.

[73] Assignee: The United States of America as represented by the United States Department of Energy, Washington, D.C.

[21] Appl. No.: 821,665

[22] Filed: Aug. 4, 1977

Related U.S. Application Data

[63] Continuation-in-part of Ser. No. 717,430, Aug. 24, 1976, abandoned.

[51] Int. Cl.[2] ..... B01D 21/01

[52] U.S. Cl. ..... 210/51; 21/56; 208/11 LE; 208/265; 208/266

[58] Field of Search ..... 208/8, 11 LE, 265, 266; 210/42 R, 43, 45, 47, 51–53, 56, 59, 71

[56] References Cited

U.S. PATENT DOCUMENTS

| | | | |
|---|---|---|---|
| 3,084,118 | 4/1963 | Overholt et al. | 208/265 |
| 3,151,054 | 9/1964 | Layng | 210/59 |
| 3,232,861 | 2/1966 | Gorin et al. | 208/10 |
| 3,607,720 | 9/1971 | Paulson | 208/11 LE |
| 3,748,254 | 7/1973 | Gorin | 210/8 |
| 3,816,305 | 6/1974 | Schutte | 210/42 R |
| 3,846,276 | 11/1974 | Walker | 208/11 LE |

FOREIGN PATENT DOCUMENTS

| | | | |
|---|---|---|---|
| 1475383 | 2/1967 | France | 210/43 |
| 384269 | 12/1932 | United Kingdom. | |
| 647138 | 12/1950 | United Kingdom. | |
| 934986 | 8/1963 | United Kingdom. | |

*Primary Examiner*—Frank A. Spear, Jr.
*Assistant Examiner*—Peter A. Hruskoci
*Attorney, Agent, or Firm*—Dean E. Carlson; Stephen D. Hamel; Allen H. Uzzell

[57] ABSTRACT

An improvement in the separation of suspended solids from coal-derived liquids by a separations process in which solids size is a separations parameter is achieved by contacting the coal-derived liquid containing suspended solids with an effective amount of an additive selected from the group of sulfuric acid, phosphoric acid, phosphoric anhydride and salts of sulfuric and phosphoric acid, and maintaining the contacted liquid at a temperature within the range of about 150°–400° C and for a time sufficient to achieve the desired separation rate.

10 Claims, 2 Drawing Figures

METHOD FOR IMPROVING THE SEDIMENTATION AND FILTERABILITY OF COAL-DERIVED LIQUIDS

BACKGROUND OF THE INVENTION

This invention was made in the course of, or under, a contract with the U.S. Energy Research and Development Administration. It is related in general to the art of coal liquefaction and particularly to the separation of finely divided solid particles from coal liquefaction products.

CROSS REFERENCE TO RELATED APPLICATION

This application is a continuation-in-part of Ser. No. 717,430, filed Aug. 24, 1976 now abandoned.

A variety of processes have been proposed for converting solid carbonaceous material such as coal, oil shale, tar sands, etc. into a liquid form reduced in impurities such as sulfur and ash. Some liquefaction processes convert the carbonaceous material into a liquid fuel suitable for combustion or a synthetic crude suitable for use as a feed for a gasoline refining plant. Other liquefaction processes, generally termed solvent refining processes, convert coal into a low melting solid substantially free of sulfur and ash for use as a clean boiler fuel. Typical of such coal liquefaction processes are those described in *Liquid Fuels From Coal,* G. K. Goldman, Noyes Data Corporation, Park Ridge, New Jersey (1972). Typically, coal liquefaction processes involve reacting finely crushed coal with a source of hydrogen, either a hydrogen donor solvent such as tetrahydronaphthalene or hydrogen gas or both. The reaction products are of very complex chemical composition and contain insoluble materials such as ash and heavy organics which must be separated from the product prior to use or downstream catalytic reactions. This invention is directed to a separation method for separating suspended solids from coal-derived liquids. For purposes of our process, "coal-derived liquids" is intended to include the carbonaceous liquid product resulting from the liquefaction of coals, lignites, oil shale, tar sands, etc. regardless of the particular liquefaction process and the term is intended to include solutions of liquid coal products in miscible solvents such as hydrogenation solvents.

The separation of suspended solids from coal-derived liquids is one of the more formidable problems facing the establishment of a large-scale coal liquefaction industry. The solids content of most coal-derived liquids is largely present as sub-micron particles, including inorganic ash particles. Some coal-derived liquids contain as much as about 10 wt.% solids consisting of particles, 90% of which are smaller than one micron. Several methods of separating coal-derived liquids have been proposed including filtration, magnetic separation, flash distillation, hydroclones, centrifuges, and settling. With the exception of flash distillation each of these methods depend upon the size of the particles as a separation parameter and would be enhanced if the particles were made significantly larger than their original size.

PRIOR ART

In the prior art, several methods have been proposed for de-ashing coal-derived liquids. One method, disclosed in U.S. Pat. No. 3,748,254, describes the possibility of settling at 600° F to achieve the desired degree of separation. Another method is solvent extraction with dilute acids as disclosed in U.S. Pat. No. 3,232,861. According to this process, coal extract is contacted with an aqueous phase under pressure at a temperature of 25°–370° C with a water-to-extract volume ratio of between 0.5–4.0. An acidic solution, dilute HCl, is preferred in this method. The preferred conditions are a slightly acidic solution, 200°–300° C and a pressure between 250 and 1600 psig for 20–60 minutes. A disadvantage to this process is that it would either consume vast quantities of water and acid or require water recycle. Also, certain organic materials present are known to be acid extractable, and these must be recovered prior to release of water to the environment. In addition, extraction into aqueous phases is capable of removing at best only about 60% of the ash and successive extraction or a solids/liquid separation is required to effect additional ash removal.

Another prior art approach is to cause the precipitation of particles by the addition of an anti-solvent such as hexane. Such processes, for example as described in U.S. Pat. No. 3,018,241, require recycle and loss of considerable amounts of valuable benzene-soluble coal extract liquid.

Other techniques involve the addition of quantities of specific fractions of coal liquefaction product liquids. U.S. Pat. No. 3,852,182 discloses the addition of a product fraction generally boiling between 250° F and 750° F and less aromatic than the liquefaction solvent. The amount of liquefaction product promoter required was a promoter/coal solution weight ratio between 0.2:1 and 4.0:1.

Another prior art approach, described in U.S. Pat. No. 3,790,467, was to increase the particle size of solids in coal-derived liquid by adding to the coal liquefaction product a coal extract liquid derived from the coal liquefaction product and containing at least 20 volume percent of materials boiling below about 400° F or at least 20 volume percent of materials boiling above about 1000° F. By increasing the size of solids to be separated, the efficiency of separation processes in which solids size is a separation factor is correspondingly enhanced.

In U.S. Pat. No. 3,607,718, it was observed that when unfiltered coal-derived liquid is passed into a settler through a heavy filtered sludge layer, that micron sized particles of insoluble material tend to agglomerate and settle more quickly to provide a clarified liquid phase which requires no additional filtering.

One disadvantage in the prior art processes involving the addition of materials to coal-derived liquid to promote precipitation and enlargement of solids is the requirement for separating and clean-up of large quantities of promoter materials. In U.S. Pat. No. 3,084,118, a process utilizing a two component additive is described. An aromatic hydrocarbon precipitant such as benzene is added to a coal hydrogenation product, along with 2–5% sulfuric acid. At moderate temperatures, up to 35° C, the sulfuric coagulates the precipitant, causing it to form a sludge which settles to the bottom of the vessel, carrying with it solid particles of ash, catalyst, etc. Additional processing is needed to recover valuable products from the sludge. The process requires the recycle and recovery of large quantities of precipitant, 50–100% of the volume of the liquefaction product. In addition, the process requires cooling of the hydrogenation product to 35° C prior to addition of the precipitant. Since coal hydrogenation products are typically produced at temperatures greater than 300° C, the requirement for cooling prior to solids removal represents a substantial investment in the form of heat exchange equipment, large settling vessels, etc. The large quantities of sludge would cause severe plugging problems in filtration processes so the separation step is limited to sedimentation-type processes.

SUMMARY OF THE INVENTION

It is an object of this invention to provide a method for separating solids from coal-derived liquids including solutions of liquid coal products which does not require the separation and recovery of an aqueous phase.

It is a further object of this invention to provide a method for increasing the size of particulate solids in coal-derived liquids including solutions of liquid coal products which does not require the addition of expensive materials or the recycle of large quantities of precipitation solvents or liquefied coal product fractions.

It is a further object to provide a method for enhancing the separation of solids from coal-derived liquids which requires the addition of only small quantities of inexpensive material which need not be recovered.

These and other objects are achieved according to our invention in a process for separating suspended solids from a coal-derived liquid in which solids size is a separation parameter, the improvement comprising contacting said coal-derived liquid containing suspended solids with an additive selected from the group consisting of $P_2O_5$, $H_2SO_4$, $H_3PO_4$ and salts of sulfuric and phosphoric acid and maintaining the contacted liquid within the range of about 150°–400° C for a time sufficient to achieve the desired separation rate, said additive present in an amount sufficient to enhance the rate of increase of the effective particle size of said solids. The improvement step of our invention may be used in combination with any solids/liquid separation method such as settling, filtration, centrifugation, hydrocycloning etc. in which the separation rate is enhanced by an increase in the size of suspended particles. The preferred method is to utilize the improvement step as part of a sedimentation process. This is easily accomplished by maintaining the contacted coal-derived liquid containing suspended solids at a temperature of 150°–400° C for sufficient time to allow suspended particles to settle to provide a clarified coal-derived liquid substantially free of solids. By "substantially free of solids" is meant sufficiently free of solids to meet the requirements of subsequent use or treatment of the coal-derived liquid, such as catalytic hydrogenation and cracking, etc. For purposes of this invention, the term "effective amount" is defined to be that amount of additive sufficient to increase the separation rate (settling rate, filtration rate, etc.) over that rate obtained from the effects of temperature alone, and is at least about 0.01 wt.% with respect to total weight of liquid and solids.

DETAILED DESCRIPTION

Figure 1:
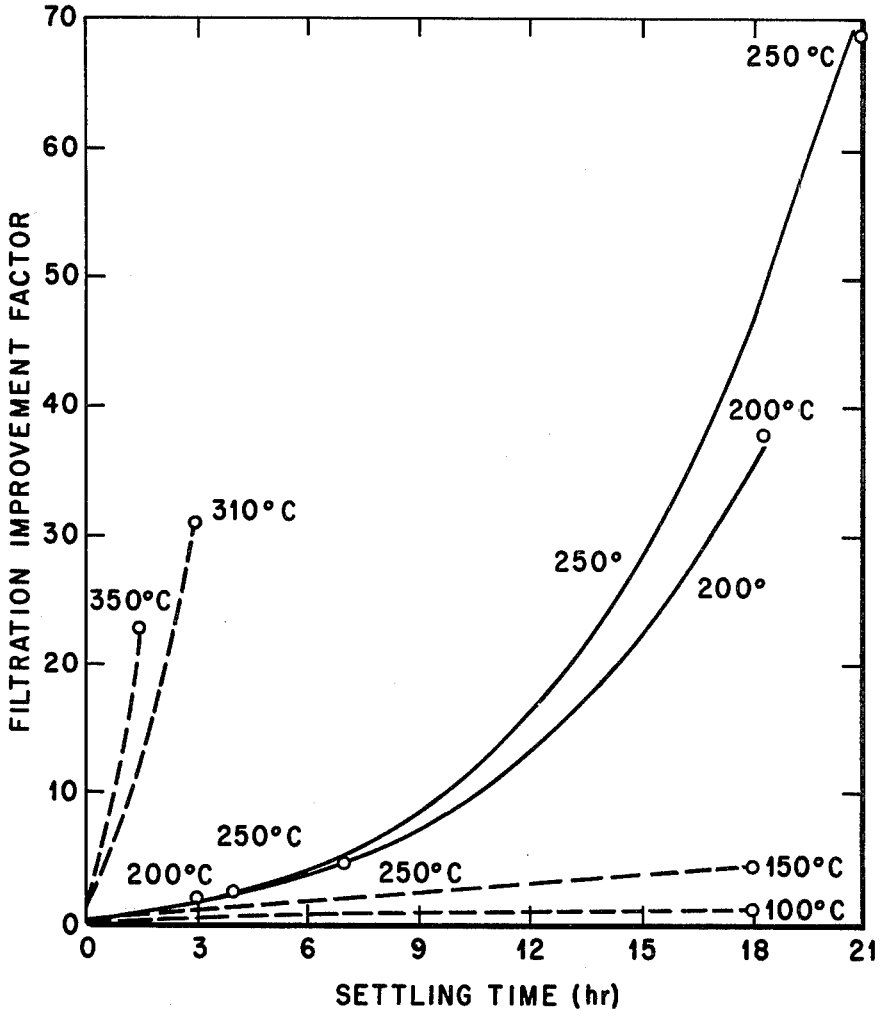
FIG. 1 is a graph showing the filtration improvement factor variation with time at various temperatures for coal-derived liquid without additives of our invention.
Figure 2:
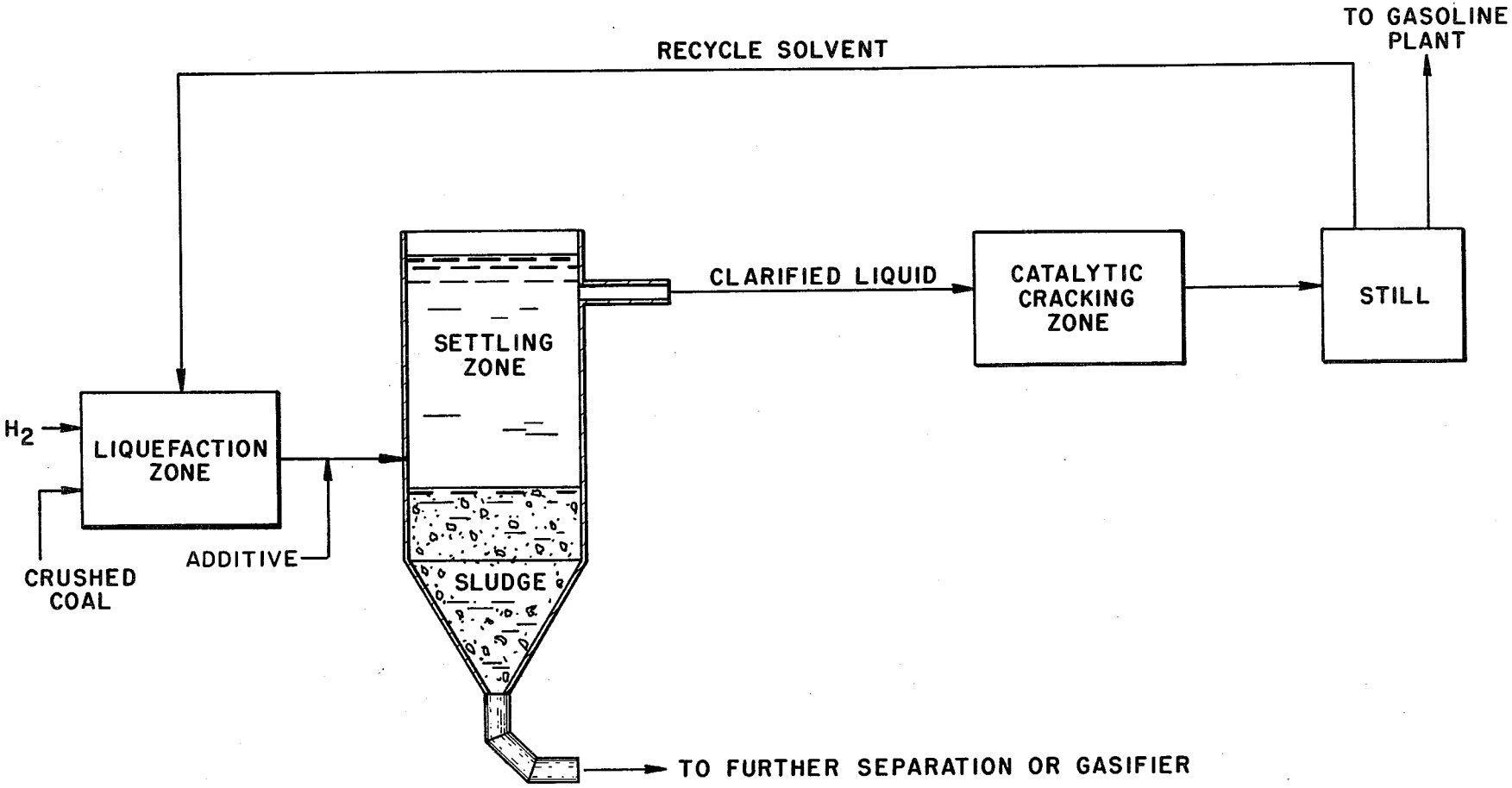
FIG. 2 is a block diagram showing our process used to enhance recovery in a sedimentation process, as described in the preferred embodiment.

It has been found that increases in sedimentation rates of suspended solids from coal-derived liquids at temperatures between about 200°–400° C are due not only to the expected reduction in viscosity but also to the reformation and agglomeration of suspended solids into larger particles. The reformation is a function of time and temperature and is depicted in the graph of FIG. 1. As shown the filtration rate, which is a function of particle size, increases with temperature, with greater times necessary at lower temperatures to achieve the same increase. The data for the figure was taken by conducting sedimentation tests of unfiltered product from a solvent refined coal process involving dissolving finely ground coal in recycle solvent with $H_2$ present. The liquid samples were taken from the 3rd one-tenth fraction from the top of an unagitated container. The filtration improvement factor is calculated as the ratio of the time required to obtain a specified amount of filtrate in a standard filtration test for the sample of unsettled liquid at room temperature to the time for the liquid settled for the specified time at the specified temperature. As shown, at 150° C and below, little improvement is observed. At 200° C and above, the filtration rate is improved drastically as time increases. The optimum temperature range for settling is about 300°–375° C for 1–3 hours. Above 375° C the nature of the coal-derived liquid begins to change. The observed increases in settling rates are not due solely to reduced viscosity but for the most part to an increase in the effective particle size of the solids. Stoke's law calculations of the increase in settling rate due to reduced viscosity at higher temperatures account for less than one-tenth of the observed increase. For purposes of this invention "effective particle size" is that particle size which would correspond to the observed sedimentation velocity according to Stoke's law assuming spherical particles, regardless of whether the increase is due to a reformation of particles or an agglomeration effect.

An important aspect of our invention lies in the discovery that certain materials, when added to coal-derived liquid containing suspended solids at 150°–400° C in small amounts, 0.01 – 3.0 wt.%, enhance the rate of increase in effective particle size over that rate achieved by temperature effects alone. We have found that the addition of sulfuric acid, phosphoric acid, phosphoric anhydride and salts of sulfuric and phosphoric acid significantly enhance the settling rate of suspended solids in coal-derived liquids at 150°–400° C. The exact mechanism is not understood, however, it is believed that the sulfate and phosphate particles or droplets act as attraction sites for micron and submicron sized particles, thereby enhancing the rate of agglomeration and reformation. While water soluble sulfates and phosphates have been used as flocculating agents for particles in aqueous solutions, the beneficial effect on solids sedimentation in coal-derived liquids was unexpected and surprising due to the complexity of the solids composition and the fact that the additives are generally not soluble in coal-derived liquids.

According to our process, a separations process for suspended solids from coal-derived liquid is improved by contacting the coal-derived liquid with an additive and maintaining the contacted liquid within the range of 150°–400° C for a time sufficient to achieve the desired separation rate. The additive is selected from the group of sulfuric acid, phosphoric acid, phosphoric anhydride, and salts of sulfuric and phosphoric acid and is present in an amount sufficient to enhance the rate of increase in the effective particle size of the solids. The effective concentrations will vary somewhat for different additives but are within the range of 0.01–3.0 wt.% with respect to total liquid and solid content of the coal-derived liquid or solution thereof entering the separation zone. Since the additive will not likely be recycled, only those additives which are effective in concentrations of 3.0 wt.% or less are considered economical. In general, each additive is effective at temperatures within the range of 150°–400° C for accelerating the enlargement of solid particles.

The process of this invention contemplates the addition of an additive consisting essentially of inorganic acid and/or salts as opposed to the prior art method of U.S. Pat. No. 3,084,118 which required a two-component additive containing both an aromatic precipitant and a 2–5% surfuric acid coagulant. Our process achieves efficient solids separation without the requirement for substantial cooling or the handling of large quantities of organic precipitation solvents.

Examples of inorganic additives effective for our process are $H_2SO_4$, $Al_2(SO_4)_3$, $(NH_4)_2SO_4$, $NH_4HSO_4$, $H_3PO_4$, $AlPO_4$, $(NH_4)_2HPO_4$, $Na_3PO_4$, $K_3PO_4$, $P_2O_5$, etc. Since it is believed that the enhancement of particle reformation is due to the sulfate and phosphate components of the additive, other salts of sulfuric and phosphoric acid (sulfates, phosphates, hydrogen sulfates, hydrogen phosphate, etc.) may be used similarly. Undoubtedly, other salts and organic esters of sulfuric or phosphoric acid can be found which enhance the reformation and agglomeration of solids in coal-derived liquids, and such materials are contemplated as equivalents of the additives specifically disclosed.

As a general rule we have observed that salts of phosphoric acid appear to be more effective than salts of sulfuric acid, and ammonium salts of sulfuric and phosphoric acid appear to be more effective than other salts. In general, $H_2SO_4$ and $H_3PO_4$ may be efficiently used even below 200° C and salts of phosphoric acid are more effective above 250° C. As little as 0.01 wt.% additive would demonstrate a measurable degree of increase in particle sedimentation rate. Concentrations in excess of about 3.0 wt.% produce little additional benefit and should be avoided for reasons of economy. The contemplated economically operable range of additive concentration is 0.01–3.0 wt.% with 0.1–1.0 wt.% preferred. Of course, the optimum temperatures and concentrations of a particular additive can be expected to vary slightly for different coal-derived liquids and different ash contents and it is a matter of routine optimization, well within the skill of the art, to determine which additive is most cost effective at which temperatures and which concentrations.

Pressure is not critical to the separations mechanism, but the coal-derived liquid should normally be kept under at least about 20–200 psig to prevent volatilization at the temperatures of separation. Since settling rates according to our process are not so dependent on viscosity, the lower boiling fraction of the coal-derived liquid could be flashed off prior to solids separation to correspondingly reduce the pressure during separation, reducing the expense of the separation zone containment. Based upon the teachings of this disclosure, it is a matter of routine screening to determine other salts of sulfuric or phosphoric acid which are sufficiently effective for use in our process. For example, since about 3.0 wt.% is the upper limit which can be economically tolerated without recovery, the artisan need only add incremental amounts of candidate salt from 0.01–3.0 wt.% at about 350° C and compare the settling rate with a control held at the same temperature. Any candidate which demonstrates an improvement in settling rate over the control is effective for enhancing the rate of increase in the effective particle size of the solids and is suitable for use in our process. It is then a matter of routine optimization to determine the concentration and time needed to most economically achieve the desired degree of separation.

EXAMPLE

Unfiltered product oil from the Solvent Refined Coal pilot plant at Wilsonville, Alabama, containing approximately 7% solids, 3.2% ash, and 0.9% sulfur was used in a series of tests to determine the effect of the additives upon the settling characteristics of the particles; 50% of the particles were smaller than 1 micron in diameter prior to treatment as determined by electron microscopy. For these tests, 175 grams of the unfiltered oil was placed to a 14-inch height in a 1 in. × 18 in. metal tube and sealed. The sealed tube was rapidly heated to test conditions, held for a prescribed time, rapidly cooled, and divided into ten vertical fractions. The temperature used for the tests was 280° C and the holding time was 70 minutes at temperature. Using $NH_4HSO_4$ and $(NH_4)_2SO_4$, the results are set out in Table I.

Table I

| Additive, Wt. % | Sedimentation Fraction (From Top) | Percent Ash Controls | Percent Ash With Additive |
|---|---|---|---|
| $NH_4HSO_4$, 0.4 | 1 | 0.46,0.30 | 0.07 |
| | 3 | 1.72,1.87 | 0.56 |
| $NH_4HSO_4$, 0.2 | 1 | 1.81,1.87 | 0.02 |
| | 2 | | 0.02 |
| | 3 | 1.99,2.01 | 0.04 |
| | 5 | | 1.28 |
| | 7 | | 2.17 |
| | 10 | | 6.39 |
| $(NH_{42}SO_4$, 0.2 | 1 | 1.81,1.87 | 0.025 |
| | 2 | | 0.72 |
| | 3 | 1.99,2.01 | 0.90 |
| | 5 | | 1.48 |
| | 7 | | 1.85 |
| | 10 | | 6.44 |

As shown, the ash content for the first and third fractions from the top is significantly reduced with the additive over the control. It is apparent that the use of additive significantly enhances the particle agglomeration and reformation which has been demonstrated to take place upon heat treatment alone. Table II depicts the parameters which have thus far provided the greatest improvement over control samples for various additives, as seen by visual observation during similar sedimentation tests. The conditions are not optimized and are presented only to show the preferred conditions for these additives as ascertained by screening tests.

Table II

| Additive | Concentration (% by wt.) | Time (min) | Temperature (° C) |
|---|---|---|---|
| $H_2SO_4$ | 0.5 | 70 | 280° |
| $Al_2(SO_4)_3$ | 0.2 | 70 | 280° |
| $(NH_{42}SO_4$ | 0.2 | 70 | 280° |
| $NH_4HSO_4$ | 0.2 | 70 | 280° |
| $H_3PO_4$ | 0.8 | 48 | 280° |
| $P_2O_5$ | 2.5 | 48 | 280° |
| $AlPO_4$ | 0.4 | 70 | 300–340° |
| $(NH_4)_2HPO_4$ | 0.2 | 70 | 280° |

Of course the selection of a particular additive will be largely a matter of economics. Sulphuric acid appears to be the most attractive from an economy standpoint while phosphoric acid appears to result in the greatest degree of improvement. Sulphuric and phosphoric acid may be added at any concentration, but the preferred forms are as commercial grade concentrated acid, at least 50 and preferably 99+ wt.% to avoid extraneous water. Sulfuric acid might also be added by bubbling $SO_3$ or $SO_2$ through the coal-derived liquid. We have observed that when $H_2SO_4$, $H_3PO_4$, or $P_2O_5$ is added to coal-derived liquids small pockets of a denser liquid phase appear with particles collecting in the heavier phase. This appears to aid in the settling by flocculating nearby particles and perhaps reducing the viscosity of the upper phase. As shown in Table II, $H_2SO_4$ is effective in our process in amounts smaller than 1 wt.%, as opposed to the 2–5% needed in the U.S. Pat. No. 3,084,118 process. The difference is highly significant since $H_2SO_4$ will likely not be recovered. Even at 0.5 wt.% additive according to our process, 2–3 tank cars of $H_2SO_4$ per day would be required for a 100,000 bbl/day liquefaction plant.

According to our process coal-derived liquid, or a solution thereof, containing suspended solids is contacted with an effective amount of additive, at least 0.01% by weight, at a temperature of 150°–400° C. The desired degree of particle enlargement will depend upon the desired separation rate, which would ordinarily be maximized. In actuality, other process conditions would likely determine the desired separation rate such as permissible hold-up time, flow rates, settling equipment size, etc. The liquid is held for sufficient time to achieve the desired degree of particle enlargement and then separation is effected by any means in which particle size is a parameter, such as sedimentation, filtration, centrifugation, hydrocloning, etc. When particulate solid additives are used, it is preferred that they be ground as very fine, such as 400 mesh (U.S. Standard Sieve Series) and be initially dispersed within the feed liquid by stirring, etc. prior to settling. The preferred separation method for the use of our step is sedimentation, since adequate clarity can be achieved without additional equipment merely by holding the coal-derived liquid for sufficient time to achieve the ultimate desired clarity. As shown in FIG. 1, the settling rate increases more rapidly at temperatures above about 300° C and the preferred temperature range for carrying out our process is about 275°–375° C. Above 375° C, the nature of coal-derived liquids begins to change. The operating temperature of the settling zone according to our process would likely be governed by the temperature of prior treatment steps. Of course, the time required to obtain the desired clarity is a function of temperature. EPA requirements for ash for boiler fuels should normally be met by holding at 200°–400° C for from 1 to 20 hours without the use of additives. Generally, with additive ½ to 10 hours would be required for temperatures within the range of 150°–400° C and ½–3 hours would be required for temperatures within the range 275°–375° C. Of course, the amount of improvement would depend upon the additive. The current EPA requirement of boiler fuels is no more than 0.15% ash.

The use of $H_2SO_4$ or $H_3PO_4$ as an additive to increase separation rate in our process is readily distinguishable from the prior art methods of solvent extraction or dissolution of ash particles in dilute acids. Our process is essentially water free (only water associated with the concentrated acid is added), requiring no water recovery and purification, and therefore can be conducted at high temperatures, 150°–400° C, with a corresponding reduction in the cost of pressurized equipment. In our process, only small amounts of $H_2SO_4$ or $H_3PO_4$ are needed, which need not be recovered for economic operation. In addition, the use of water or acid solutions in prior art extraction processes requires agitation to acheive good mixing, while agitation in our process is detrimental to the formation of agglomerates and reformation of particles. And lastly, our process calls for enhancing the separation rate for processes in which particle size is a separation parameter while ash extraction processes using dilute acids do not use particle size as a separation parameter, and have not been shown to increase effective particle size to enhance the separation rate of processes in which particle size is a separation parameter. For purposes of our process, separation rate is defined as the rate of solids recovery for the separation process.

DESCRIPTION OF THE PREFERRED EMBODIMENT

To illustrate our process, the following example is presented. It is not intended to be limiting, the invention being limited only by the claims. Crushed coal is supplied to a liquefaction zone where it is dissolved in a process derived liquefaction solvent boiling in the range of about 260°–370° C. The liquefaction zone is operated at a temperature of 425°–455° C and a pressure of about 1000–1800 psig. The liquid product from the liquefaction zone is a solution of coal-derived liquid in liquefaction solvent and contains suspended solids which include ash and insoluble organic material. Typically 50% of the particles are less than 1 micron as determined by electron microscopy. Ammonium phosphate salt is added to the liquid product to a concentration of about 2000 ppm by wt. with respect to total liquid and solid concentration of the liquid product stream. The liquid product is transported to a separation zone which in this case is a sedimentation zone operated at about 310° C. The residence time in the sedimentation zone is about ¾ hour with clarified liquid removed from the upper portion and sludge pumped from the lower portion. The sludge which contains used additive can be further separated such as by drying and the solids disposed of. Preferably the sludge is pumped to a coventional type gasifier where it is reacted with steam and oxygen under pressure to produce pipeline gas. The clarified liquid is fractionally distilled with the fraction boiling between about 260° to 370° C being recycled to the liquefaction zone to function as a liquefaction solvent. Of course, it can be readily appreciated by those skilled in the art that the particular liquefaction solvent or subsequent treatment of the clarified liquid or sludge are not a part of our invention, which deals only with the separation of suspended solids from the liquefaction product solution. Alternatively, ammonium phosphate can be replaced in this example by effective amounts of sulfuric acid, phosphoric acid, phosphoric anhydride or other salts of sulfuric and phosphoric acid. Of course, the optimum performance for each additive may be achieved by appropriately varying the temperature and additive concentration. Such testing is of a repetitive nature and well within the skill of the art. An advantage inherent in our process is that coal liquefaction processes normally produce sufficient quantities of sulfur oxides, sulfuric acid and $NH_3$ to be used to produce ammonium salts or sulfates for use as additives. Our process provides the art of coal liquefaction with an inexpensive method for enhancing reformation and increase of particle size of suspended solids in coal-derived liquids.

What is claimed is:

1. In a process for separating suspended solids from the carbonaceous liquid product resulting from the liquefaction of coals, lignites, oil shale, and tar sands in which solids size is a separation parameter, said suspended solids including ash and insoluble organic matter, the improvement comprising maintaining said carbonaceous liquid product containing solids at 150°–400° C to increase the effective particle size of said solids as a function of time while contacting said carbonaceous liquid product containing solids with an additive consisting essentially of material selected from the group of $P_2O_5$, $H_2SO_4$, $H_3PO_4$, and salts of sulfuric and phosphoric acid, for a time sufficient to enhance the rate of increase of said effective particle size said additive present in a concentration of about 0.01–3.0 wt.% with respect to said carbonaceous liquid containing solids, and separating said suspended solids from said carbonaceous liquid product at said temperature.

2. The process of claim 1 in which said additive is selected from the group of $P_2O_5$, $H_3PO_4$ and salts of sulfuric and phosphoric acid.

3. The process of claim 1 in which said additive is present in a concentration of about 0.1–1.0% with respect to carbonaceous liquid product containing solids.

4. The process of claim 1 in which said additive is selected from the group of $P_2O_5$, $H_2SO_4$, $H_3PO_4$, $Al_2(SO_4)_3$, $NH_4HSO_4$, $AlPO_4$, $(NH_4)_2HPO_4$, $K_3PO_4$, $Na_3PO_4$, and $(NH_4)_3PO_4$.

5. The process of claim 4 in which said additive is present in a concentration of about 0.1–1.0% with respect to carbonaceous liquid product containing solids.

6. The process of claim 1 in which said contacted liquid is maintained within said temperature range for sufficient time to allow suspended solids to settle to provide a clarified carbonaceous liquid product substantially free of solids.

7. The process of claim 1 in which said temperature is within the range of 275°–375° C.

8. The process of claim 1 in which said additive is selected from the group of salts of sulfuric and phosphoric acid.

9. The process of claim 1 in which said additive is selected from the group of $H_3PO_4$, $P_2O_5$ and salts of phosphoric acid.

10. The process of claim 1 in which said process for separating suspended solids is a filtration process.

* * * * *